US006253536B1

(12) United States Patent
Han

(10) Patent No.: US 6,253,536 B1
(45) Date of Patent: Jul. 3, 2001

(54) STEEL CORD FOR RADIAL TIRE

(75) Inventor: Yong Shick Han, Taejon-shi (KR)

(73) Assignee: Hankook Tire Co., Ltd., Seoul (KR)

( * ) Notice: Subject to any disclaimer, the term of this patent is extended or adjusted under 35 U.S.C. 154(b) by 0 days.

(21) Appl. No.: 09/357,088

(22) Filed: Jul. 19, 1999

(30) Foreign Application Priority Data

Sep. 10, 1998 (KR) ..... 98-37287

(51) Int. Cl.[7] ..... D02G 3/36

(52) U.S. Cl. ..... 57/212; 57/237; 57/902; 152/527; 152/556

(58) Field of Search ..... 57/236, 237, 238, 57/211, 213, 214, 218, 902, 210; 152/527, 556

(56) References Cited

U.S. PATENT DOCUMENTS 4,609,024 * 9/1986 Yatsunami et al. ..... 152/527
4,690,191 * 9/1987 Kawasaki ..... 152/527
5,213,640 * 5/1993 Ikehara ..... 152/451
5,598,693 * 2/1997 Yanagisawa et al. ..... 57/212
5,706,641 * 1/1998 Ishizaka ..... 57/212
5,802,829 * 9/1998 Yamanaka ..... 57/212
5,968,651 * 10/1999 De Vos et al. ..... 428/377

* cited by examiner

*Primary Examiner*—Danny Worrell
(74) *Attorney, Agent, or Firm*—Fish & Richardson P.C.

(57) ABSTRACT

A steel cord for radial tires having a "2+5" construction structured by twisting a core and a strand in such a fashion that they have the same twist pitch length and the same twist direction, so that the number of processing steps for the twisting process is reduced from two to one, thereby reducing the manufacturing costs while achieving an improvement in productivity.

2 Claims, 1 Drawing Sheet

STEEL CORD FOR RADIAL TIRE

BACKGROUND OF THE INVENTION

1. Field of the Invention

The present invention relates to a steel cord for radial tires, and more particularly relates to a steel cord for radial tires having a construction including a "2+5" bi-diametric cord formed by twisting a core and a strand in such a fashion that they have the same twist pitch length and the same twist direction, so that the number of processing steps for the twisting process is reduced from two to one, thereby reducing the manufacturing costs while achieving an improvement in productivity.

2. Description of the Prior Art

In a steel cord having a two-layer twisted construction, a core, which forms a first layer of the steel cord, and a strand, which forms a second layer of the steel cord, are typically different from each other in terms of twist pitch length and twist direction as follows:

Steel Cord Construction: 1×3(0.20)+6(0.35)

Twist Pitch Length of Core: 10 mm

Twist Pitch Length of Strand: 18 mm

Twist Direction of Core: S (Right)

Twist Direction of Strand: Z (Left)

For this reason, it is impossible to carry out the twisting process for the manufacture of such a cord using a single processing step. Conventionally, the twisting process has been carried out using two processing steps. However, this results in an increase in the manufacturing costs for cords. Furthermore, the contact between the core and strand is rendered to be a point contact. Where such a cord is applied to a tire, a stress concentration occurs at portions of the cord, where point contacts are formed, during the use of the tire. Due to such a stress concentration, a fretting phenomenon occurs which results in a degradation in the durability of the tire.

In order to reduce the above mentioned drawback, a method for the manufacture of steel cords having a two-layer twisted construction has been proposed in which a steel cord is formed by twisting a core and a strand in such a fashion that they have different twist pitch lengths while having the same twist direction as follows:

Steel Cord Construction: 1×2+7(0.30)

Twist Pitch Length of Core: 8 mm

Twist Pitch Length of Strand: 16 mm

Twist Direction of Core: S (Right)

Twist Direction of Strand: S (Right)

In this case, it is still impossible to carry out the twisting process for the manufacture of such a cord using a single processing step because the core and strand are different in terms of twist pitch length. Consequently, the twisting process has been carried out using two processing steps in accordance with this method. For this reason, an increase in the manufacturing costs for cords is still involved. Although line contacts are formed between the core and strand by virtue of the same twist direction, they are unstable because the core and strand have different twist pitch lengths. In other words, although this method can reduce the durability degradation of the tire to a some degree, it has a limitation in completely eliminating the fundamental problems.

Meanwhile, in the case of a cord layered with topping rubber, an insufficient penetration of the topping rubber into the core layer may occur. Where such a cord is applied to a tire, such an insufficient penetration of the topping rubber results in a movement of the core layer. As a result, corrosion of the cord caused by moisture or salt is accelerated, thereby greatly degrading the durability of the tire.

SUMMARY OF THE INVENTION

Therefore, an object of the invention is to eliminate the above mentioned problems and to provide a steel cord for radial tires having a construction formed by twisting a core and a strand in such a fashion that they have the same twist pitch length and the same twist direction, so that the number of processing steps for the twisting process is reduced from two to one, thereby reducing the manufacturing costs while achieving an improvement in productivity, and so that the core and strand are in stable and almost complete line contact with each other, thereby achieving an improvement in the durability of tires to which the steel cord is applied.

In accordance with the present invention, this object is accomplished by providing a steel cord for radial tires and a radial tire using the steel cord in a belt, a carcass, or a chafer thereof, the steel cord comprising: a core layer having two filaments twisted to have a twist pitch length of 10 mm to 22 mm; a strand layer having five filaments twisted to have the same twist pitch length and the same twist direction as the core layer; and said filaments of said core and strand layers being made of a carbon steel having a carbon content ranging from 0.70% to 0.96% by weight and being plated with brass at respective surfaces thereof to obtain an enhanced adhesion force to rubber, said filaments having a tensile strength of 260 kgf/mm$^2$ to 385 kgf/mm$^2$ prior to twisting thereof to form said steel cord.

In accordance with the present invention, the core and strand layers have the same twist direction and the same twist pitch length. Accordingly, the core and strand are not in point contact with each other, but is in line contact with each other. Therefore, the steel cord of the present invention minimizes the occurrence of the fretting phenomenon. In addition, the twisting process for the manufacture of the cord construction according to the present invention can be achieved using a single processing step, as compared to those for conventional constructions involving two processing steps.

BRIEF DESCRIPTION OF THE DRAWINGS

Other objects and aspects of the invention will become apparent from the following description of embodiments with reference to the accompanying drawing in which.

DESCRIPTION OF THE PREFERRED EMBODIMENTS

Figure 1:
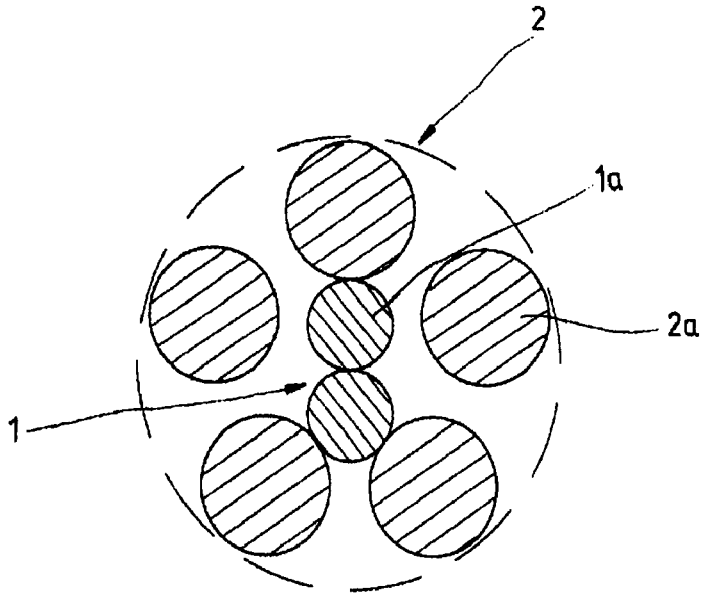
FIG. 1 is a cross-sectional view illustrating a steel cord for radial tires according to the present invention.

Referring to FIG. 1, a steel cord having a construction according to the present invention is illustrated.

As shown in FIG. 1, the steel cord includes a core layer 1 consisting of two twisted filaments 1*a,* and a strand layer 2 disposed around the core layer 1 and consisting of five twisted filaments 2*a*. In accordance with the present invention, the filaments 1*a* and 2*a* are made of carbon steel having a carbon content of 0.70% to 0.96% by weight. In order to obtain an improved adheison force to rubber, the filaments 1*a* and 2*a* are plated with brass. The filaments la in the core layer 1 and the filament 2*a* in the strand layer 2 have the same twist pitch length and the same twist direction. Preferably, the twist pitch length ranges from 10 mm to 22 mm. It is also preferred that the filaments 1*a* and 2*a* of the core layer 1 and strand layer 2 have a tensile strength of 260 kgf/mm$^2$ to 385 kgf/mm$^2$ prior to twisting thereof to form the steel cord.

Preferably, the filaments 1*a* of the core layer 1 have a diameter dc ranging from 0.15 mm to 0.30 mm whereas the filaments 2*a* of the strand layer 2 have a diameter ds ranging from 0.20 mm to 0.40 mm. It is also preferred that the ratio between the filament diameters do and ds, that is, ds/dc, be within a range of 1.35 to 1.90.

Since the core layer and strand layer have the same twist direction and the same twist pitch length in accordance with the present invention, they are in line contact with each other, as compared to conventional constructions involving point contact. Accordingly, the steel cord of the present invention minimizes the occurrence of the fretting phenomenon. In addition, the twisting process for the manufacture of the cord construction according to the present invention can be achieved using a single processing step, as compared to those for conventional constructions involving two processing steps.

In order to evaluate the steel cord according to the present invention, the physical properties of a cord sample formed using conditions of ds=0.35 mm, dc=0.25 mm, and ds/dc=1.40 were measured. The results obtained after the measurement are described in Table 1.

TABLE 1

| Physical Properties | Measured Value |
|---|---|
| Tensile Force (kgf) | 15 |
| Twist Pitch Length (mm) | 15 |
| Elongation (%) | 2.4 |
| Elasticity (%, Loop Test) | 93 |
| Stiffness (g-cm)* | 120 |
| Antifatigue Property** | More than 1 million cycles |

*: measured by a Taber stiffness tester while using conditions of a sample length of 7 cm, an angle of 15°, a proportional constant of 10, and a load of 1,000 g

**: corresponding to the number of cycles in the completely full tension and reversed cycle of stress condition by a rotating beam fatigue tester and the applied stress level is 90 kgf/mm$^2$.

As apparent from the above description, the present invention provides a steel cord for radial tires having a construction formed by twisting a core and a strand in such a fashion that they have the same twist pitch length and the same twist direction, so that the core and strand are in stable and almost complete line contact with each other. A fretting fatigue occurring between the core and strand due to repeated movements of a tire, to which the steel cord is applied, is minimized by virtue of the stable and complete line contact between the core and strand. This results in an improvement in the durability of the tire. In accordance with the present invention, the diameters of the core and strand are appropriately determined to allow a sufficient amount of topping rubber to penetrate into the steel code through gaps defined among filaments of the strand. Accordingly, it is possible to eliminate the problem associated with a movement of the core. This provides an improvement in the durability of the tire.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A steel cord for radial tires and a radial tire using the steel cord in a belt, a carcass, or a chafer thereof, the steel cord comprising:

a core layer having two filaments twisted to have a twist pitch length of 10 mm to 22 mm;

a strand layer having five filaments twisted to have the same twist pitch length and the same twist direction as the core layer; and said filaments of said core and strand layers being made of a carbon steel having a carbon content ranging from 0.70% to 0.96% by weight and being plated with brass at respective surfaces thereof to obtain an enhanced adhesion force to rubber, said filaments having a tensile strength of 260 kgf/mm$^2$ to 385 kgf/mm$^2$ prior to twisting thereof to form said steel cord.

2. The steel cord in accordance with claim 1, wherein said filaments of said core layer have a diameter (dc) ranging from 0.15 mm to 0.30 mm, said filaments of said strand layer have a diameter (ds) ranging from 0.20 mm to 0.40 mm, and the ratio between the filament diameters (dc and ds) , that is, "ds/dc", is within a range of 1.35 to 1.90.

* * * * *

UNITED STATES PATENT AND TRADEMARK OFFICE

CERTIFICATE OF CORRECTION

PATENT NO. : 6,253,536 B1
DATED : July 3, 2001
INVENTOR(S) : Yong Sig Han

It is certified that error appears in the above-identified patent and that said Letters Patent is hereby corrected as shown below:

Title page,
Item [75], "Yong Shick Han" should be -- Yong Sig Han --.

Signed and Sealed this

Sixteenth Day of July, 2002

*Attest:*

*Attesting Officer*

JAMES E. ROGAN
*Director of the United States Patent and Trademark Office*